US009001099B2

(12) United States Patent
Ono et al.

(10) Patent No.: US 9,001,099 B2
(45) Date of Patent: Apr. 7, 2015

(54) IMAGE DISPLAY AND IMAGE DISPLAY METHOD

(75) Inventors: Munenori Ono, Kanagawa (JP); Katsuhide Uchino, Kanagawa (JP); Hiroshi Hasegawa, Kanagawa (JP); Kazuo Nakamura, Kanagawa (JP)

(73) Assignee: Sony Corporation, Tokyo (JP)

( * ) Notice: Subject to any disclaimer, the term of this patent is extended or adjusted under 35 U.S.C. 154(b) by 194 days.

(21) Appl. No.: 12/943,518

(22) Filed: Nov. 10, 2010

(65) Prior Publication Data

US 2011/0115773 A1 May 19, 2011

(30) Foreign Application Priority Data

Nov. 17, 2009 (JP) ..... 2009-262251

(51) Int. Cl.
*G06F 3/038* (2013.01)
*G09G 3/32* (2006.01)

(52) U.S. Cl.
CPC ..... *G09G 3/3233* (2013.01); *G09G 2300/0842* (2013.01); *G09G 2320/046* (2013.01); *G09G 2320/048* (2013.01); *G09G 2320/0613* (2013.01); *G09G 2320/103* (2013.01)

(58) Field of Classification Search
USPC ..... 345/211, 76–82
See application file for complete search history.

(56) References Cited

U.S. PATENT DOCUMENTS 5,504,504 A * 4/1996 Markandey et al. ..... 345/214
6,414,661 B1 * 7/2002 Shen et al. ..... 345/82
6,657,621 B2 * 12/2003 Staudacher ..... 345/204
8,081,239 B2 * 12/2011 Zhang et al. ..... 348/241
2002/0036632 A1 * 3/2002 Kuriyama et al. ..... 345/204
2002/0135553 A1 * 9/2002 Nagai et al. ..... 345/89
2005/0093850 A1 * 5/2005 Mori et al. ..... 345/204
2005/0280766 A1 * 12/2005 Johnson et al. ..... 349/167
2006/0164348 A1 * 7/2006 Ozawa et al. ..... 345/76
2008/0204378 A1 * 8/2008 Park et al. ..... 345/77
2008/0284702 A1 * 11/2008 Shidara et al. ..... 345/90

FOREIGN PATENT DOCUMENTS

JP 2007-206463 8/2007

* cited by examiner

*Primary Examiner* — Kathy Wang-Hurst
*Assistant Examiner* — Joseph Fox
(74) *Attorney, Agent, or Firm* — Wolf, Greenfield & Sacks, P.C.

(57) ABSTRACT

An image display includes: a display panel in which a plurality of pixels including first display elements, respectively, are two-dimensionally arranged; a drive section deriving, from a plurality of pieces of still image data and display times of a plurality of still images based on the plurality of pieces of still image data, an accumulated display time of each first display element in each still image data when the plurality of still images are sequentially displayed from one to another, and deriving, from the accumulated display time of each first display element derived in each still image data and degradation characteristic data stored in a memory section, a correction amount of each still image data in each pixel, and further sequentially displaying a plurality of still images based on a plurality of pieces of still image data corrected with use of the obtained correction amount from one to another.

8 Claims, 3 Drawing Sheets

IMAGE DISPLAY AND IMAGE DISPLAY METHOD

CROSS REFERENCE TO RELATED APPLICATIONS

The presented application claims priority under 35 U.S.C. §119 to Japanese Patent Application No. JP 2009-262251, filed in the Japan Patent Office on Nov. 17, 2009, the entire contents of which are incorporated herein by reference.

BACKGROUND OF THE INVENTION

1. Field of the Invention

The present invention relates to an image display which displays an image by driving, for example, a self-luminous element such as an organic EL (Electro Luminescence) element and an image display method.

2. Description of the Related Art

In recent years, in the field of displays displaying an image, displays using, as light-emitting elements of pixels, current drive type optical elements of which light emission luminance changes depending on the value of a current flowing therethrough, for example, organic EL (Electro Luminescence) elements have been developed for commercialization. Unlike a liquid crystal element or the like, the organic EL element is a self-luminous element. Therefore, in a display (an organic EL display) using the organic EL element, a light source (a backlight) is not necessary, so compared to a liquid crystal display needing a light source, a reduction in the profile of the display and an increase in the luminance of the display are allowed. In particular, in the case where the display uses an active matrix system as a drive system, each pixel is allowed to continuously emit light, and a reduction in power consumption is allowed. Therefore, the organic EL display is expected to become a mainstream of next-generation flat panel display.

The organic EL element is a current drive type light-emitting element, and is an element allowed to adjust gradation by controlling the amount of a current flowing therethrough. However, the organic EL element has a characteristic of being degraded according to its light emission amount and its current-carrying time, and luminance of an organic EL element in an advanced stage of degradation relatively declines, compared to luminance of an organic EL element in a less-advanced stage of degradation. On the other hand, luminance of a displayed image is not uniform in all pixels, so degradation in organic EL elements in all pixels are not also uniform. Therefore, a decline in luminance according to degrees of degradation in the organic EL elements occurs in a display region.

This phenomenon is called "burn-in", and in particular, when a still image is displayed on a display screen for a long time, burn-in easily occurs. To accurately correct "burn-in", it is necessary to correctly detect actual degradation states of organic EL elements. As one solution to this issue, for example, a large number of methods of correcting a picture signal with use of a degradation amount of each pixel derived from an accumulated light emission time have been reported, for example, as described in Japanese Unexamined Patent Application Publication No. 2007-206463.

SUMMARY OF THE INVENTION

However, in a display described in Japanese Unexamined Patent Application Publication No. 2007-206463, a picture signal is inputted from outside at any time, so it is difficult to predict a picture signal to be inputted. Therefore, it is necessary to count an accumulated display time in real time. Moreover, it is difficult to previously derive a correction amount for a picture signal, so it is necessary to derive a correction amount in real time. As a result, a system becomes large.

It is desirable to provide an image display and an image display method which are allowed to reduce burn-in with a simple system.

According to an embodiment of the invention, there is provided an image display including: a display panel including a display region where a plurality of pixels including first display elements of a self-luminous type, respectively, are two-dimensionally arranged; and a memory section storing degradation characteristic data of the first display elements. The image display further includes a drive section. The drive section derives, from a plurality of pieces of still image data inputted from outside and display times of a plurality of still images based on the plurality of pieces of still image data to the display region, an accumulated display time of each first display element in each still image data when the plurality of still images are sequentially displayed on the display region from one to another. The drive section also derives, from the accumulated display time of each first display element derived in each still image data and the degradation characteristic data, a correction amount of each still image data in each pixel, and further sequentially displays, on the display region, a plurality of still images based on a plurality of pieces of still image data corrected with use of the obtained correction amount from one to another.

According to an embodiment of the invention, there is provided an image display method in an image display which includes a display region where a plurality of pixels including display elements of a self-luminous type, respectively, are two-dimensionally arranged, the method including the following three steps of:

(1) deriving, from a plurality of pieces of still image data inputted from outside and display times of a plurality of still images based on the plurality of pieces of still image data to the display region, an accumulated display time of each first display element in each still image data when the plurality of still images are sequentially displayed on the display region from one to another;

(2) deriving, from the accumulated display time of each first display element derived in each still image data and the degradation characteristic data, a correction amount of each still image data in each pixel; and (3) further sequentially displaying, on the display region, a plurality of still images based on a plurality of pieces of still image data corrected with use of the obtained correction amount from one to another.

In the image display and the image display method according to the embodiment of the invention, a plurality of pieces of still image data used for image display and the display times of a plurality of still images based on the plurality of pieces of still image data are known before image display. Therefore, the accumulated display time of each first display element, that is, a degradation amount is allowed to be estimated, so the correction amount for each pixel of each still image data is allowed to be determined before image display.

In the image display and the image display method according to the embodiment of the invention, one or a plurality of dummy pixels including second display elements of a self-luminous type, respectively, and a photosensor detecting light emitted from the one or the plurality of dummy pixels may be arranged in a non-display region. In such a case, degradation characteristic data is allowed to be corrected with use of a photodetection signal outputted from the photosensor.

In the image display and the image display method according to the embodiment of the invention, the correction amount for each pixel in each still image data inputted from outside is determined before image display. Therefore, it is not necessary to count the accumulated display time in real time or to derive a correction amount in real time, so burn-in is allowed to be reduced with a simple system.

Other and further objects, features and advantages of the invention will appear more fully from the following description.

DETAILED DESCRIPTION OF THE PREFERRED EMBODIMENTS

A preferred embodiment will be described in detail below referring to the accompanying drawings. Descriptions will be given in the following order.

1. Embodiment (refer to FIGS. 1 and 2)
2. Modifications (refer to FIG. 3)

Embodiment

Schematic Configuration of Display 1

Figure 1:
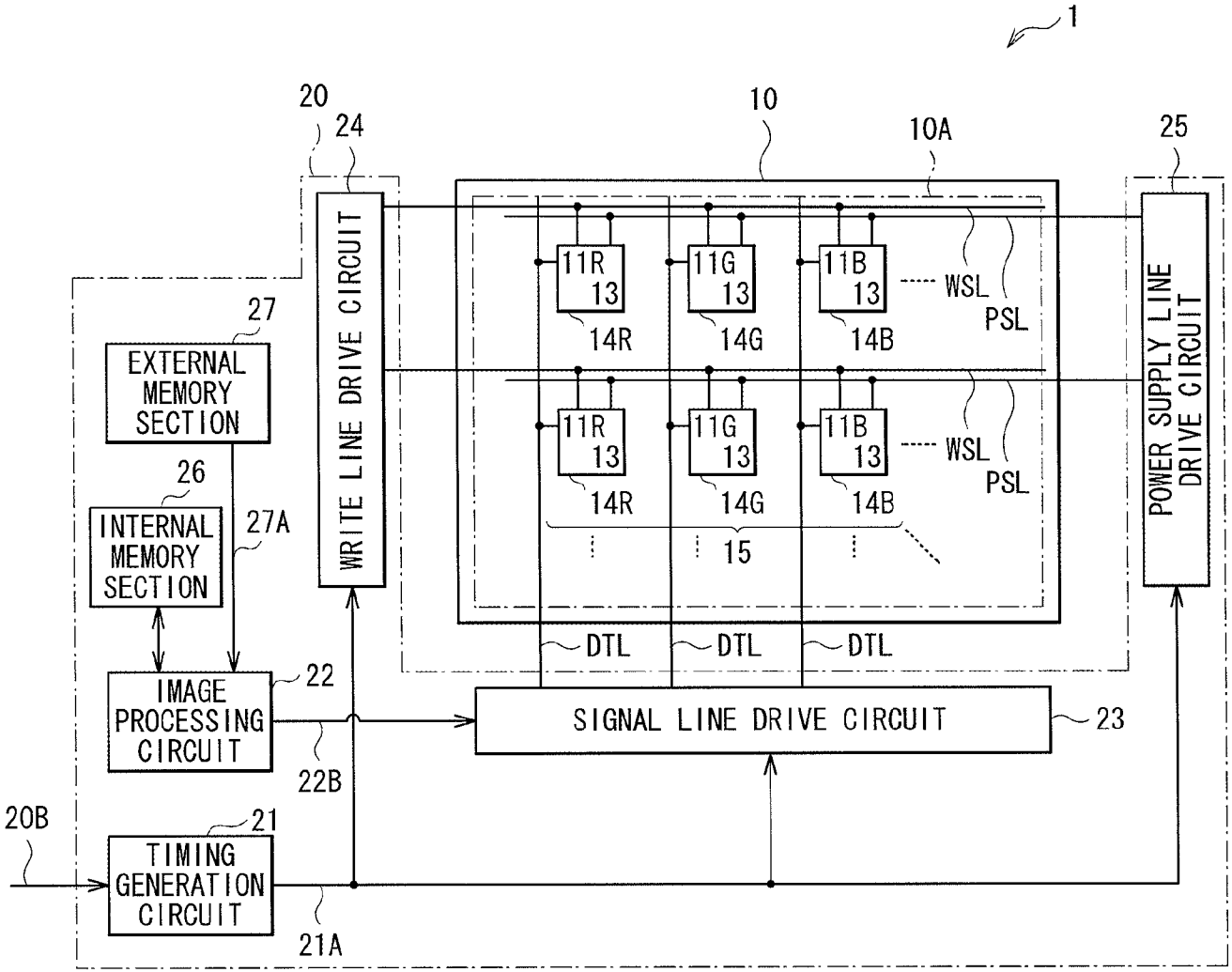
FIG. 1 is a schematic configuration diagram of a display according to an embodiment of the invention.

FIG. 1 illustrates a schematic configuration of a display 1 according to an embodiment of the invention. For example, the display 1 is suitably applicable as a display for still images which sequentially displays a plurality of still images from one to another on a screen. The display 1 includes, for example, a display panel 10 and a drive circuit 20 (a drive section) driving the display panel 10.

The display panel 10 includes a display region 10A where three kinds of organic EL elements 11R, 11G and 11B (first display elements of a self-luminous type) emitting different colors from one another are two-dimensionally arranged. The display region 10A is a region where a picture is displayed with use of light emitted from the organic EL elements 11R, 11G and 11B. The organic EL elements 11R, 11G and 11B are organic EL elements emitting red light, green light and blue light, respectively. Hereinafter, the organic EL elements 11R, 11G and 11B are collectively called organic EL elements 11 as necessary.

Display Pixel 15

Figure 2:
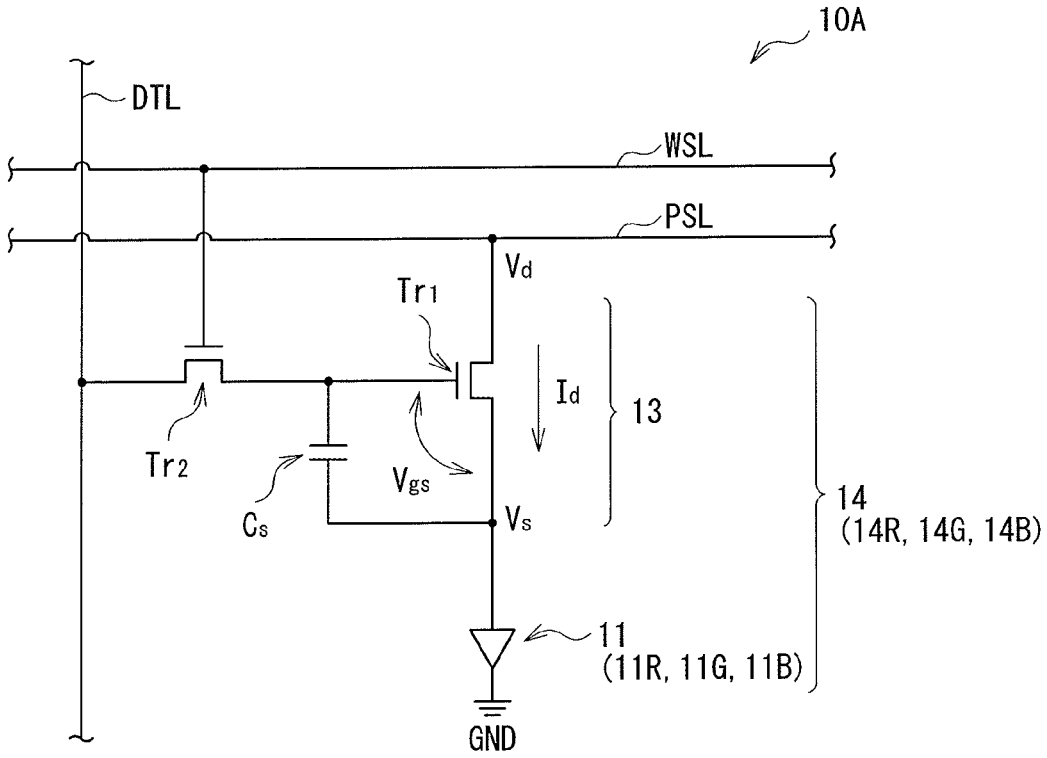
FIG. 2 is a configuration diagram in a display region in FIG. 1.
Figure 3:
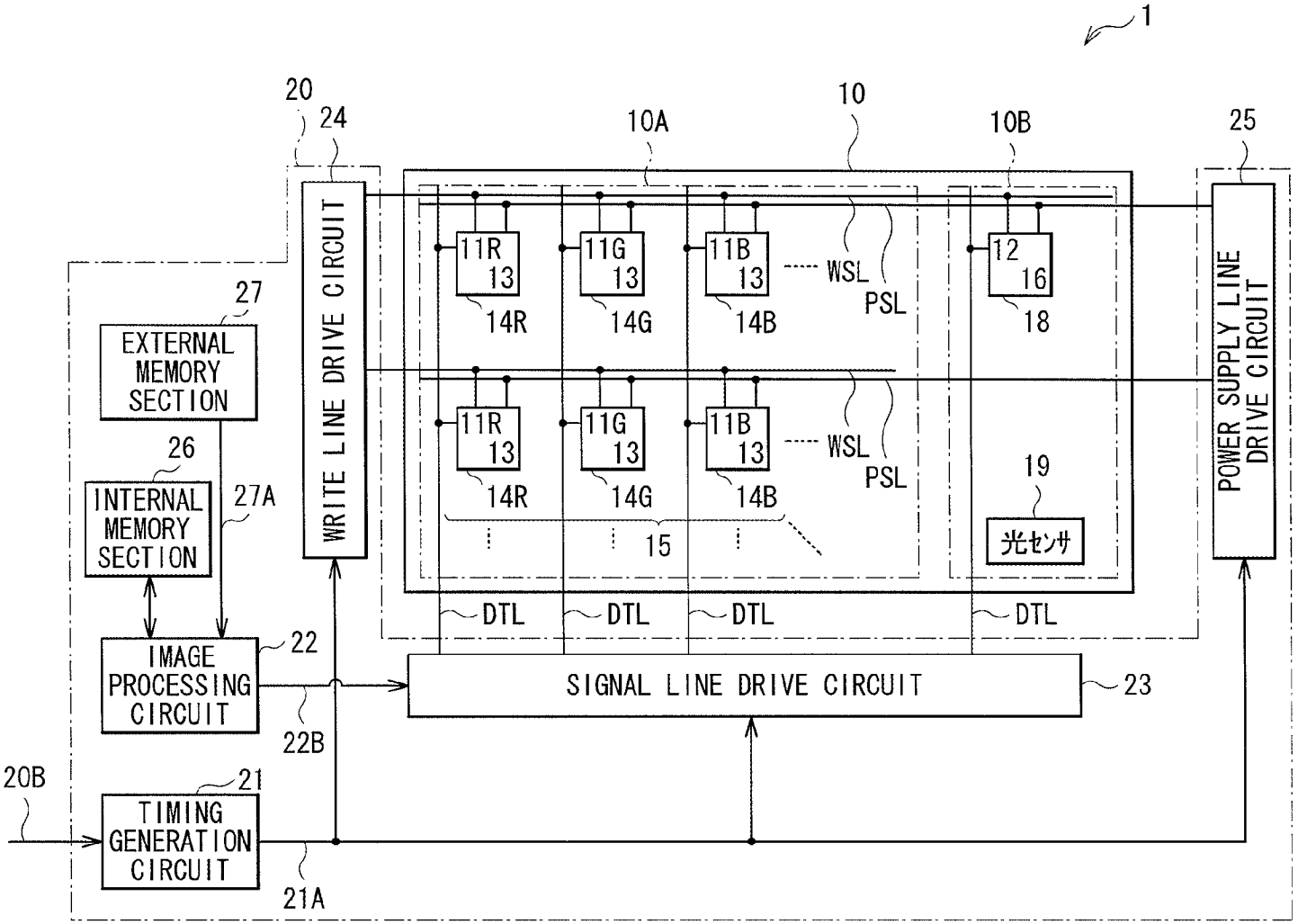
FIG. 3 is a schematic configuration diagram of a modification of the display in FIG. 1.

FIG. 2 illustrates an example of a circuit configuration in a display region 10A. In the display region 10A, a plurality of pixel circuits 13 are two-dimensionally arranged so as to be paired with the organic EL elements 11, respectively. In the embodiment, a pair of the organic EL element 11 and the pixel circuit 13 configures one sub-pixel 14. More specifically, as illustrated in FIGS. 1 and 3, a pair of the organic EL element 11R and the pixel circuit 13 configures one sub-pixel 14R, and a pair of the organic EL element 11G and the pixel circuit 13 configures one sub-pixel 14G, and a pair of the organic EL element 11B and the pixel circuit 13 configures one sub-pixel 14B. Moreover, three adjacent sub-pixels 14R, 14G and 14B configures one pixel (one display pixel 15).

Each pixel circuit 13 is configured of, for example, a drive transistor $Tr_1$, a write transistor $Tr_2$ and a retention capacitor $C_s$, that is, each of the pixel circuits 18 has a 2Tr1C circuit configuration. The drive transistor $Tr_1$ and the write transistor $Tr_2$ each are configured of, for example, an n-channel MOS type thin film transistor (TFT). The drive transistor $Tr_1$ or the write transistor $Tr_2$ may be configured of, for example, a p-channel MOS type TFT.

In the display region 10A, a plurality of signal lines DTL are arranged in a column direction, and a plurality of scanning lines WSL and a plurality of power supply lines PSL (members where a power supply voltage is supplied) are arranged in a row direction. One organic EL elements 11 is arranged around each of intersections of the signal lines DTL and the scanning lines WSL. Each of the signal lines DTL is connected to an output end (not illustrated) of a signal line drive circuit 23 which will be described later and one of a drain electrode and a source electrode (both not illustrated) of the write transistor $Tr_2$. Each of the scanning lines WSL is connected to an output end (not illustrated) of a scanning line drive circuit 24 which will be described later and a gate electrode (not illustrated) of the write transistor $Tr_2$. Each of the power supply lines PSL is connected to an output end (not illustrated) of a power supply line drive circuit 25 which will be described later and one of a drain electrode and a source electrode (both not illustrated) of the drive transistor $Tr_1$. One (not illustrated) which is not connected to the signal line DTL of the drain electrode and the source electrode of the write transistor Tr2 is connected to a gate electrode (not illustrated) of the drive transistor $Tr_1$ and an end of the retention capacitor $C_s$. One (not illustrated) which is not connected to the power supply line PSL of the drain electrode and the source electrode of the drive transistor $Tr_1$ and the other end of retention capacitor C, are connected to an anode electrode (not illustrated) of the organic EL element 11. A cathode electrode (not illustrated) of the organic EL element 11 is connected to, for example, a ground line GND.

Drive Circuit 20

Next, each circuit in the drive circuit 20 will be described referring to FIG. 1. The drive circuit 20 includes a timing generation circuit 21, an image processing circuit 22, the signal line drive circuit 23, the write line drive circuit 24, the power supply line drive circuit 25, an internal memory section 26 and an external memory section 27.

The internal memory section 26 stores, for example, degradation characteristic data of the organic EL element 11 in advance. The degradation characteristic data represents a relationship between an accumulated display time of the organic EL element 11 and a correction amount (for example, a correction coefficient) for gradation data. Herein, the accumulated display time is, for example, a value obtained by multiplying gradation data and a light emission time of the organic EL element 11 by each other. The accumulated display time may be a value obtained by multiplying gradation data, the light emission time of the organic EL element 11, and a coefficient for gradation by one another. The internal memory section 26 is allowed to further store an accumulated display time of each display pixel 15 which will be described later (more precisely, each sub-pixels 14) in the case where the accumulated display time is derived in a correction process which will be described later.

The external memory section 27 is removable from the display 1, and is, for example, a typical recording medium such as "MEMORY STICK (Registered Trademark of Sony Corporation)". In the external memory section 27, a plurality of pieces of still image data are stored in advance. Each still image data 27A stored in the external memory section 27 is utilized for image display in the display 1, and is, for example, digital data including gradation data corresponding to each sub-pixel 14 in the display region 10A.

The timing generation circuit 21 controls the image processing circuit 22, the signal line drive circuit 23, the write line drive circuit 24 and the power supply line drive circuit 25 to operate in synchronization with one another. The timing generation circuit 21 outputs a control signal 21A to each of the above-described circuits in response to (in synchronization with), for example, a synchronization signal 20B outputted from a system control section (not illustrated).

The image processing circuit 22 reads out, for example, a plurality of pieces of still image data 27A stored in the external memory section 27 to perform a predetermined correction process on each still image data 27A. The image processing circuit 22 starts the above-described correction process, for example, at the time of connecting the external memory section 27 to the display 1. The correction process will be described in detail later. Moreover, the image processing circuit 22 reads out a correction amount (for example, Cn(x, y) which will be described later) obtained by the correction process from the internal memory section 26 in response to (in synchronization with) an input of the control signal 21A, and then the image processing circuit 22 corrects each still image data 27A with use of the read correction amount. Next, the image processing circuit 22 outputs, as a picture signal 22B, each still image data 22A (not illustrated) obtained by correction to the signal line drive circuit 23. At this time, the image processing circuit 22 outputs the picture signal 22B to the signal line drive circuit 23 in response to (in synchronization with) the input of the control signal 21A so that a plurality of still images based on a plurality of pieces of still image data 27A are sequentially displayed from one to another.

The signal line drive circuit 23 outputs the picture signal 22B inputted from the image processing circuit 22 to each signal line DTL in response to (in synchronization with) the input of the control signal 21A so as to drive each display pixel 15. The signal line drive circuit 23 outputs a signal voltage corresponding to the display pixels in one line selected by the write drive circuit 24 to the signal lines DTL corresponding to the display pixels 15.

The write line drive circuit 24 sequentially selects one scanning line WSL from a plurality of scanning lines WSL in response to (in synchronization with) the input of the control signal 21A. The power supply line drive circuit 25 sequentially applies a power supply voltage supplied from a power supply circuit (not illustrated) to a plurality of power supply lines PSL in response to (in synchronization with) the input of the control signal 21A so as to control light emission and extinction of the organic EL elements 11.

Correction Process

Next, the above-described correction process will be described below. First, the image processing circuit 22 derives an accumulated display time of each display pixel 15 (each organic EL element 11) in each still image data 27A when a plurality of still images are sequentially displayed from one to another on the display region 10A from a plurality of pieces of still image data 27A and display times of a plurality of still images based on the plurality of pieces of still image data 27A to the display region 10A.

In this case, for example, gradation data included in each still image data 27A is Kn(x, y) (where n is image display order, x is an x coordinate value, and y is a y coordinate value), and the display time is ΔTn, a coefficient for gradation is αn, the accumulated display time is Tn(x, y), and the number of pieces of still image data 27A stored in the external memory section 27 is N. At this time, for example, the image processing circuit 22 derives the accumulated display time Tn(x, y) with use of the following mathematical formula 1.

Mathematical Formula 1

$$T_n = \sum_{n=1}^{N} \alpha_n \times K_n(x, y) \times \Delta T_n$$

Next, the image processing circuit 22 derives a correction amount for gradation data included in each still image data 27A in each display pixel 15 from the accumulated display time of each display pixel 15 derived in each still image data 27A and degradation characteristic data. More specifically, the image processing circuit 22 extracts the correction amount corresponding to the accumulated display time of each display pixel 15 derived in each still image data 27A from the degradation characteristic data. For example, the image processing circuit 22 extracts the correction amount Cn(x, y) corresponding to the accumulated display time Tn(x, y) from the degradation characteristic data. Next, the image processing circuit 22 stores the obtained correction amount in the internal memory section 26 so as to associate the correction amount with each still image data 27A. For example, the image processing circuit 22 stores the correction amount Cn(x, y) in the internal memory section 26.

Operation of Display 1

Next, an example of operation of the display 1 according to the embodiment will be described below. First, the external memory section 27 is connected to the display 1. Then, the correction amount is derived by the image processing circuit 22 to be stored in the internal memory section 26. After that, the control signal 21A is outputted from the timing generation circuit 21 to each circuit in the drive circuit 20 so that each circuit in the drive circuit 20 operates in response to an instruction of the control signal 21A. More specifically, in the image processing circuit 22, each still image data 22A is generated, and each generated still image data 22A is outputted to each signal line DTL as the picture signal 22B by the signal line drive circuit 23, and at the same time, one scanning line WSL is sequentially selected from a plurality of scanning lines WSL by the write line drive circuit 24. Moreover, a desired power supply voltage is sequentially applied to a plurality of power supply lines PSL by the power supply line drive circuit 25. Therefore, each display pixel 15 is driven, and a plurality of still images based on a plurality of pieces of still image data 27A are sequentially displayed on the display region 10A from one to another.

Effects of Display 1

Next, effects of the display 1 according to the embodiment will be described below. In the embodiment, all pieces of still image data 27A used for image display are stored in the external memory section 27, and the display times of all still images based on all pieces of still image data 27A are predetermined. In other words, all pieces of still image data 27A used for image display and the display times of all still images based on all pieces of still image data 27A are known before image display. Therefore, the accumulated display time of each display pixel 15, that is, a degradation amount is allowed to be estimated, so the correction amount for each display pixel 15 of each still image data 27A is allowed to be determined before image display. Therefore, it is not necessary to count the accumulated display time in real time or to derive a correction amount in real time, so burn-in is allowed to be reduced with a simple system.

Modifications

In the above-described embodiment, only the correction amount for each still image data 27A is derived before image display to be stored in the internal memory section 26, but, for example, each still image data 22A obtained by correction may be stored in the internal memory section 26 instead of the correction amount or with the correction amount.

Moreover, in the above-described embodiment, the degradation characteristic data stored in the internal memory section 26 is a fixed value, but the degradation characteristic data may be corrected or updated as necessary. Therefore, the correction amount for each display pixel 15 of each still image data 27A is allowed to be determined more accurately, so burn-in is allowed to be further reduced.

To correct or update the degradation characteristic data, the display 1 preferably has the following configuration. For example, as illustrated in FIG. 3, the display panel 10 includes one or a plurality of dummy pixels 18 including an organic EL element 12 and a pixel circuit 16, and a photosensor 19 detecting light emitted from the one or the plurality of dummy pixels 18 in a non-display region 10B. Moreover, the image processing circuit 22 generates a standard gradation picture signal 22B for the dummy pixels 18 to output the picture signal 22B to the signal line drive circuit 23. The signal line drive circuit 23 outputs the standard gradation picture signal 22B inputted from the image processing circuit 22 to a plurality of signal lines DTL for the dummy pixels 18 to drive the dummy pixels 18. Further, the image processing circuit 22 corrects degradation characteristic data with use of a photodetection signal outputted from the photosensor 19. Thus, the degradation characteristic data is allowed to be appropriately corrected by measuring luminance degradation.

The present application contains subject matter related to that disclosed in Japanese Priority Patent Application JP 2009-262251 filed in the Japan Patent Office on Nov. 17, 2009, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An image display comprising:

a display panel including a display region where a plurality of pixels including first display elements of a self-luminous type, respectively, are two-dimensionally arranged;

a memory section to store degradation characteristic data of the first display elements; and a drive section configured to:

derive an accumulated display time for each first display element of the display panel, wherein the accumulated display time for each first display element is derived as:

$$T_n(x, y) = \sum_{n=1}^{N} \alpha_n \times K_n(x, y) \times \Delta T_n,$$

where $\alpha_n$ is a coefficient for gradation for input still image n of a plurality N of input still images, $K_n(x,y)$ is gradation data for coordinates (x, y) in input still image n, and $\Delta T_n$ is a display time for image n;

determine, from the derived accumulated display time of said each first display element and the degradation characteristic data stored in the memory section, a correction amount for each first display element; and instruct the display panel to sequentially display, on the display region, a plurality of corrected still images corresponding to the plurality of input still images-corrected with use of the determined correction amount for each first display element.

2. The image display according to claim 1, wherein:

the degradation characteristic data represents a relationship between the accumulated display time of the first display element and a correction amount for still image data.

3. The image display according to claim 1, wherein:

the display panel includes a non-display region where one or more dummy pixels including second display elements of a self-luminous type, respectively, and a photosensor detecting light emitted from the one or more dummy pixels are arranged, and the drive section is configured to correct the degradation characteristic data with use of a photodetection signal outputted from the photosensor.

4. The image display according to claim 1, further comprising:

an external memory interface configured to connect to an external memory device, and wherein the drive section is further configured to derive the accumulated display time of each first display element in response to detecting a connection of the external memory device with the external memory interface.

5. An image display method in an image display including a display panel which includes a display region where a plurality of pixels including display elements of a self-luminous type, respectively, are two-dimensionally arranged, the method comprising:

deriving an accumulated display time for each display element of the display panel, wherein the accumulated display time for each first display element is derived as:

$$T_n(x, y) = \sum_{n=1}^{N} \alpha_n \times K_n(x, y) \times \Delta T_n,$$

where $\alpha_n$, is a coefficient for gradation for input still image n of n=1 a plurality N of input still images, $K_n(x, y)$ is gradation data for coordinates (x y) in input still image n, and $\Delta T_n$ is a display time for image n;

determining, from the derived accumulated display time of said each first display element and the degradation characteristic data, a correction amount-for each of the display elements; and sequentially displaying, on the display region, a plurality of corrected still images corresponding to the plurality of input still images corrected with use of the-determined correction amount for each of the display elements.

6. The image display method according to claim 5, wherein:

the degradation characteristic data represents a relationship between the accumulated display time of the first display element and a correction amount for still image data.

7. The image display method according to claim 5, wherein the display panel includes a non-display region where one or more dummy pixels including second display elements of a self-luminous type, respectively, and a photosensor detecting light emitted from the one or more dummy pixels are arranged, and wherein the method further comprises correcting the degradation characteristic data with use of a photodetection signal outputted from the photosensor.

8. The image display method according to claim 5, wherein the image display includes an external memory interface configured to connect to an external memory device, and wherein the method further comprises deriving the accumulated display time of each first display element in response to detecting a connection of the external memory device with the external memory interface.

* * * * *